US006217347B1

(12) United States Patent
Schell et al.

(10) Patent No.: US 6,217,347 B1
(45) Date of Patent: Apr. 17, 2001

(54) ELECTRICAL CONNECTOR HAVING MULTIPLE ARRAYS OF CONTACTS WITH CO-LINEAR MOUNTING POINTS

(75) Inventors: Mark S. Schell, Palatine, IL (US); Donald W. McClune, York, PA (US); Douglas L. Wagner, Newbury Park, CA (US)

(73) Assignee: BERG Technology, Inc., Reno, NV (US)

( * ) Notice: Subject to any disclaimer, the term of this patent is extended or adjusted under 35 U.S.C. 154(b) by 0 days.

(21) Appl. No.: 09/411,184

(22) Filed: Oct. 1, 1999

(51) Int. Cl.[7] ..... H01R 12/00
(52) U.S. Cl. ..... 439/79
(58) Field of Search ..... 439/79, 80, 607, 439/108, 541.5

(56) References Cited

U.S. PATENT DOCUMENTS

| | | | |
|---|---|---|---|
| 4,456,317 | 6/1984 | McCleerey | 339/14 R |
| 4,464,003 | 8/1984 | Goodman et al. | 339/99 R |
| 4,487,464 | 12/1984 | Kirschenbaum | 339/19 |
| 4,621,880 | 11/1986 | Rush | 339/17 LC |
| 4,708,659 | 11/1987 | Wozniczka | 439/62 |
| 4,732,565 | 3/1988 | Ito et al. | 439/79 |
| 5,176,523 | 1/1993 | Lai | 439/64 |
| 5,259,772 | 11/1993 | Fusselman et al. | 439/108 |
| 5,269,694 | 12/1993 | Kachlic et al. | 439/79 |
| 5,286,207 | 2/1994 | McHugh | 439/64 |
| 5,295,843 | 3/1994 | Davis et al. | 439/108 |
| 5,318,452 | 6/1994 | Brennian, Jr. et al. | 439/79 |
| 5,329,424 | 7/1994 | Patel | 361/775 |
| 5,547,384 | 8/1996 | Benjamin | 439/79 |
| 5,575,663 | 11/1996 | Broschard, III et al. | 439/79 |
| 5,688,130 * | 11/1997 | Huang | 439/79 |

* cited by examiner

*Primary Examiner*—Tulsidas Patel
(74) *Attorney, Agent, or Firm*—Woodcock Washburn Kurtz Mackiewicz & Norris LLP

(57) ABSTRACT

An electrical connector is adapted for use on a substantially planar surface. The connector comprises two arrays of electrical contacts coupled to the planar surface. One array is disposed directly above the other. Each contact in the lower array is mounted directly to the planar surface, with the mounting points arranged in a substantially straight line along the surface. The upper array of contacts is coupled to the planar surface by way of one or more mounting tabs fixed to the surface. The tabs elevate the upper array in relation to the planar surface and the first array. The mounting tabs are fixed to the planar surface along the same substantially straight line on which the first array is mounted. Thus, the mounting points for both arrays of contacts are disposed along the planar surface in a substantially co-liner relationship. The connector further comprises a housing that is fixed to the planar surface and engages the contacts.

21 Claims, 8 Drawing Sheets

ELECTRICAL CONNECTOR HAVING MULTIPLE ARRAYS OF CONTACTS WITH CO-LINEAR MOUNTING POINTS

BACKGROUND OF THE INVENTION

Personal computers are typically used in conjunction with peripheral devices such as disk-drive units that store and retrieve digital data from some type of storage medium. Peripheral devices supplement the computing operations carried out by the computer's microprocessor. Peripheral devices may be disposed external to the computer. Alternatively, peripheral devices may be adapted for installation within the computer. Internally-disposed peripheral devices that can be installed by the computer user are commonly available.

Internally-disposed peripheral devices are typically housed in bays within the computer. Access to these bays is typically achieved by way of an opening disposed along the computer's outer casing. The peripheral device is inserted through the access opening, thereby avoiding the need to remove the outer casing in order to install the device. The bay and the peripheral device are usually equipped with a series of rails and grooves. The rails and grooves guide the device into its installed position as it is inserted into the bay. Connectors are disposed on the peripheral device, and on one or more of the surfaces that form the sides of the bay. These connectors electrically couple the peripheral device and the computer. The connectors are typically arranged in a so-called "blind-mate" configuration, i.e., a configuration that allows a plug (male connector) and a receptacle (female connector) to mate with no action of the part of the user other than urging the two portions together in a particular alignment.

Compact external dimensions are considered a highly desirable characteristic of a personal computer. Hence, strict spatial constraints are imposed on the components utilized within such computers. These spatial constraints also apply to peripheral devices intended for use within personal computers.

Connector manufacturers have responded to the noted spatial constraints by reducing the physical dimensions of connectors employed in personal computers and peripheral devices. One means of reducing connector size is straddle mounting. The spring contacts of a straddle-mounted connecter are disposed along two facing rows wherein each contact is positioned to contact a printed circuit board positioned between the rows. This arrangement effectively doubles the number of contacts that can be accommodated within a given area on the mounting surface. The protrusion of contacts below the circuit board, however, makes straddle mounting impractical in certain densely-packaged electronic devices.

An alternative to straddle mounting consists of mounting both rows of contacts on the same side of the circuit board, with one row disposed directly above and extending beyond the other. This arrangement typically necessitates two adjacent rows of mounting points on the circuit board. Multiple rows of mounting points increase the footprint of the connector, i.e., the area on the circuit board needed to accommodate the connector. Such footprint increases consume space within the electronic device in which the connector is utilized.

It is therefore desirable to provide an improved blind-mate connector. The connector should accommodate multiple rows of electrical contacts in a manner that minimizes the dimensions of the connector both on and above the corresponding mounting surface. The present invention achieves these and other goals.

SUMMARY OF THE INVENTION

The present invention provides an electrical connector that is adapted for use on a substantially planar surface. The connector comprises a first and a second array of electrical contacts. Each array is coupled to the substantially planar surface. The second array of contacts is disposed above the first array in relation to the planar surface. Each contact in the first array is mounted directly to the planar surface, with the mounting points arranged in a substantially straight line. The second array is coupled to the planar surface by way of one or more tabs affixed to the surface. Each tab comprises a vertically-oriented member and a horizontally-oriented base. The vertically-oriented member elevates the second array in relation to the planar surface and the first array. The base of each tab is fixed to the planar surface along the same substantially straight line on which the first array of contacts is mounted. Furthermore, each tab is laterally offset from the second array of connectors, thereby allowing the second array to be positioned directly above the first array. The two arrays of contacts are thus disposed on the planar surface in a manner that minimizes the amount of space occupied by the connector both on and above the surface. A preferred embodiment of the connector further comprises a housing that is fixed to the planar surface. The housing has a plurality of apertures and troughs that engage the contacts. The contact arrays and the housing form a plug, i.e., a male connector.

The invention also provides a system for electrically coupling a first and a second electronic device. The system comprises a plug-type connector as described above, and a receptacle-type connector. The plug and the receptacle are fixed to the first and the second electronic devices, respectively. The receptacle comprises a plurality of contact elements that are adapted to engage the contact arrays of the plug. The engagement of the contact elements and the contact arrays electrically couples the first and the second electronic devices.

BRIEF DESCRIPTION OF THE DRAWINGS

The foregoing summary, as well as the following detailed description of a preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF THE PREFERRED EMBODIMENTS

The present invention provides an electrical connector that is adapted for use on a substantially planar surface. A preferred embodiment of the invention is described in conjunction with a personal computer and a peripheral device for use in the computer. This particular configuration is presented for exemplary purposes only. Accordingly, the invention should not be limited to the particular configuration shown, as the invention can be applied to other types of electronic devices.

Figure 5:
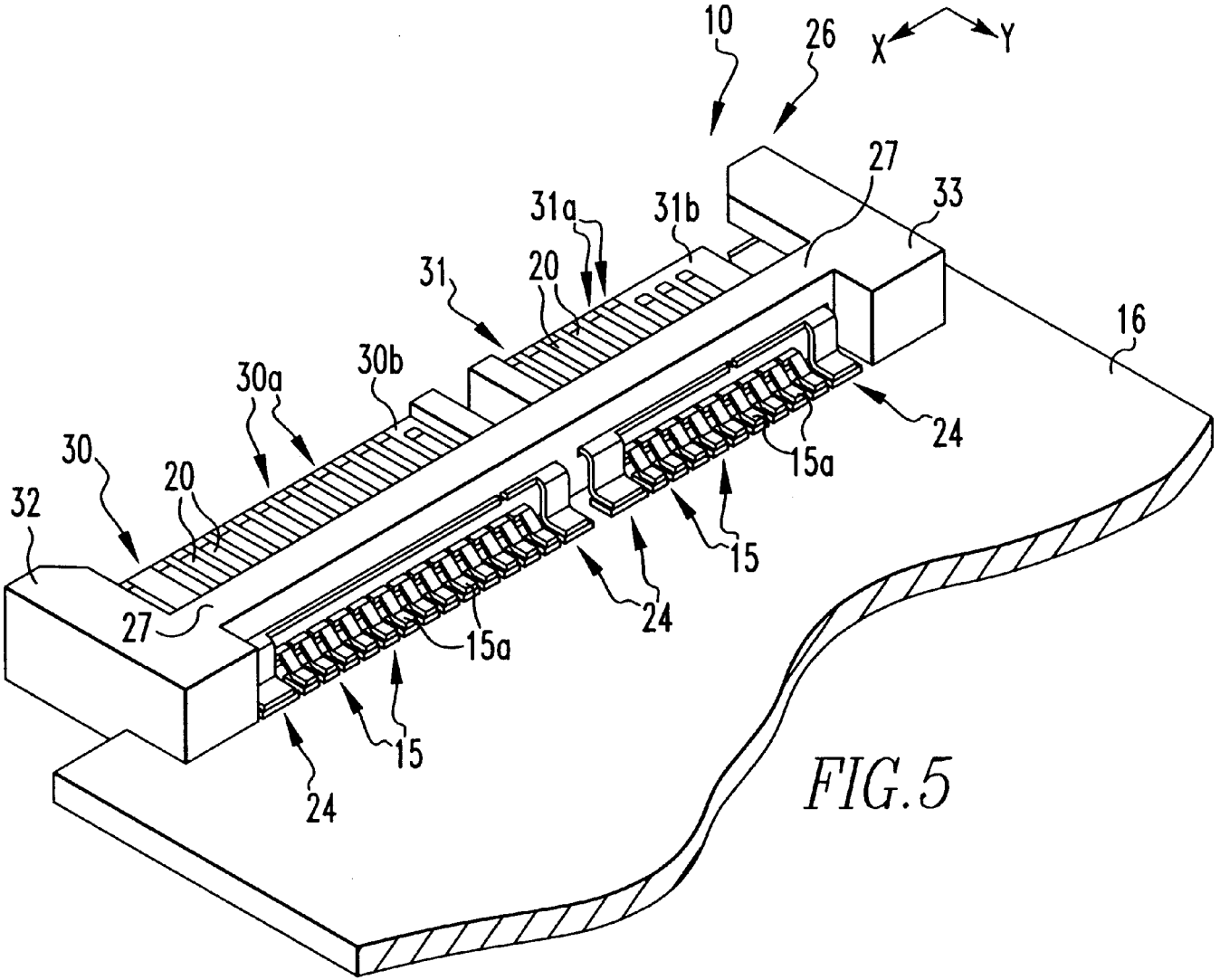
FIG. 5 is a perspective view of the connector of FIG. 1 in a fully assembled state.
Figure 6:
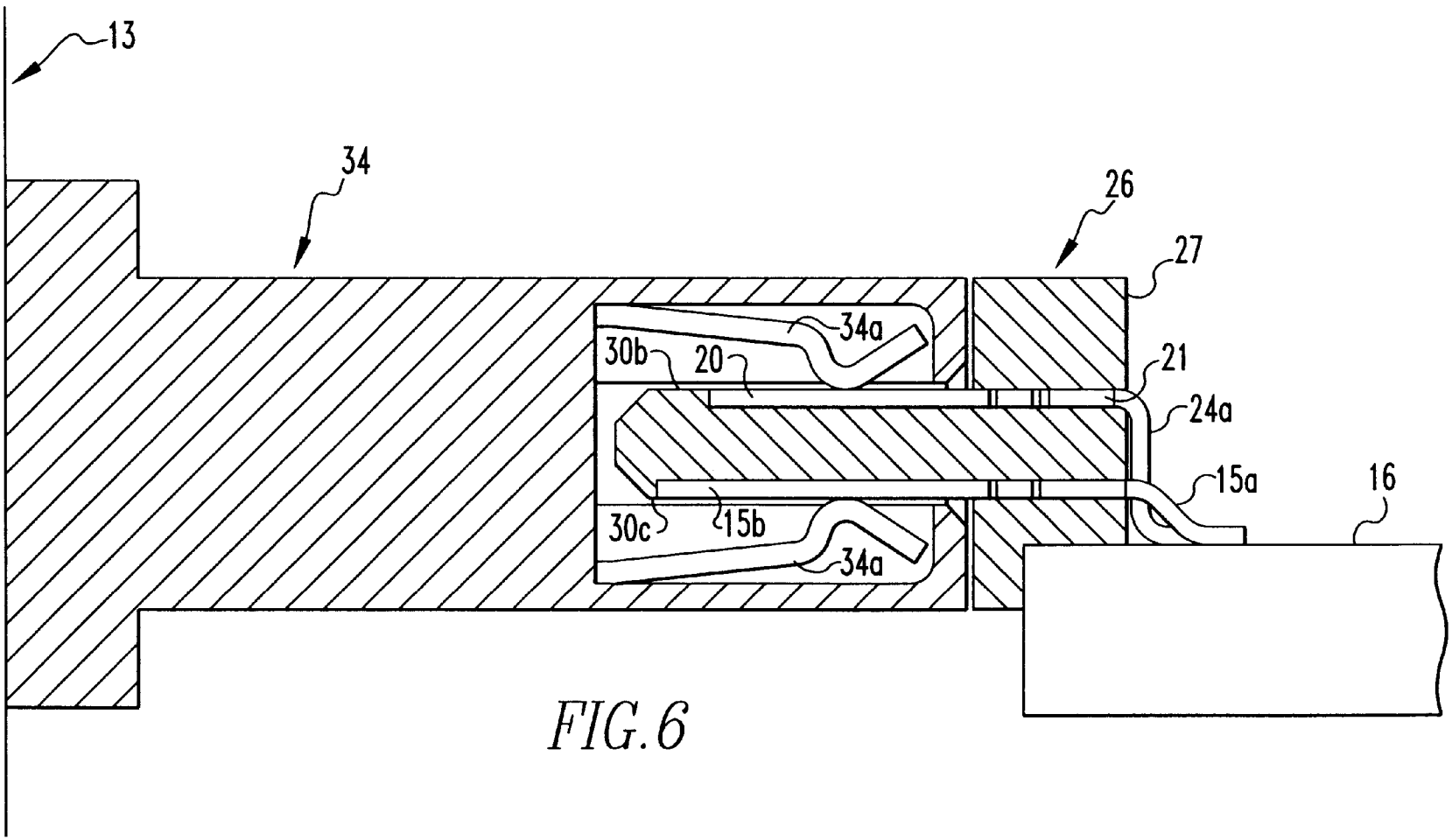
FIG. 6 is a cross-sectional view of the connector of FIG. 1 and a receptacle that engages the connector.
Figure 7:
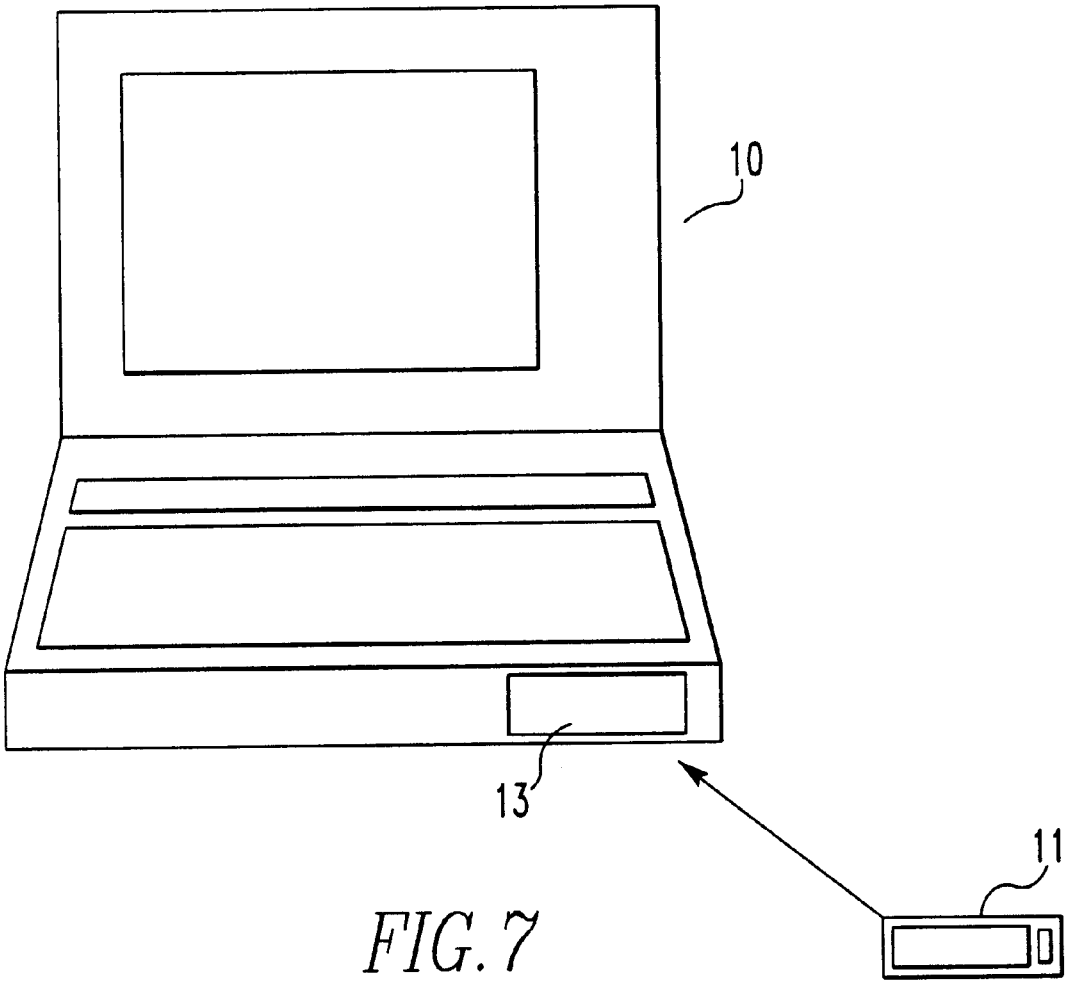
FIG. 7 is a front view of a computer and a peripheral device in which the connector of FIG. 1 can be utilized.

A presently-preferred embodiment of the invention is illustrated in FIGS. 1 through 6. The invention provides an electrical connector 10. The exemplary connector 10 is a plug (male connector) that is adapted to engage a receptacle (female connector). As an example, the connector 10 may be used in conjunction with a peripheral device 11 for a personal computer 12, as shown in FIG. 7. The peripheral device 10 may be any of a number of commonly-available accessories for personal computes 12, such as a removable disk-drive unit. The peripheral device 10 is adapted for installation in a bay 13 within the computer 12. The bay 13 is accessible from the exterior of the computer 12, thereby allowing the user to install the peripheral device 11 without removing the outer casing of the computer 12. The connector 10 is utilized to electrically couple the peripheral device 11 and the computer 12.

Figure 2:
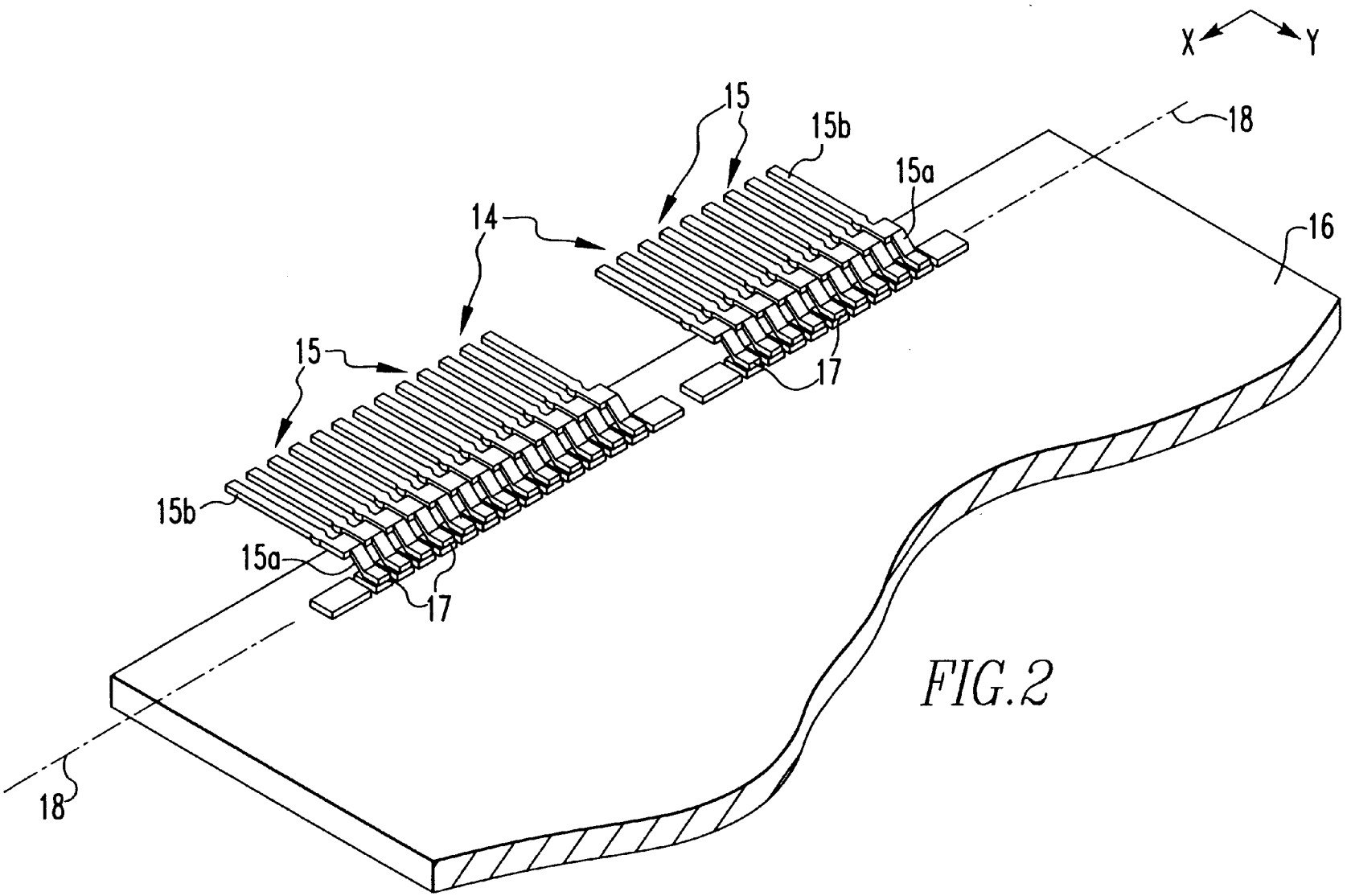
FIG. 2 is a perspective view showing a lower array of electrical contacts of the connector of FIG. 1.

The connector 10 comprises a first electrical-contact array 14. The array 14 comprises one or more electrical contacts 15. The contacts 15 are disposed on a substantially planar surface, as is best shown in FIG. 2. In the exemplary embodiment, the planar surface is a printed circuit (PC) board 16, and the contacts 15 are fixed to the board 16 by soldering. Other types of mounting surfaces and other attachment means are also within the contemplated scope of the invention. The PC board 16 is disposed along the exterior of the exemplary peripheral device 11.

The contacts 15 are disposed in a substantially parallel orientation. The center-to-center distance between adjacent contacts 15 is preferably about 0.050 inches. The exemplary embodiment comprises a total of twenty-two contacts 15. Each contact 15 comprises a solder tail 15*a*. Each solder tail 15*a* is fixed to the PC board 16 at a mounting point 17. The mounting points 17 are disposed in a substantially co-linear arrangement on the board 16. Hence, the mounting points 17 define a substantially straight line 18 along the surface of the board 16. Each contact 15 further comprises an elevated section 15*b*. Each elevated section 15*b* is fixed to the raised end of a solder tail 15*a*. The elevated sections 15*b* are thus disposed at a fixed height above the board 16, and share a substantially co-planar relationship.

Figure 4:
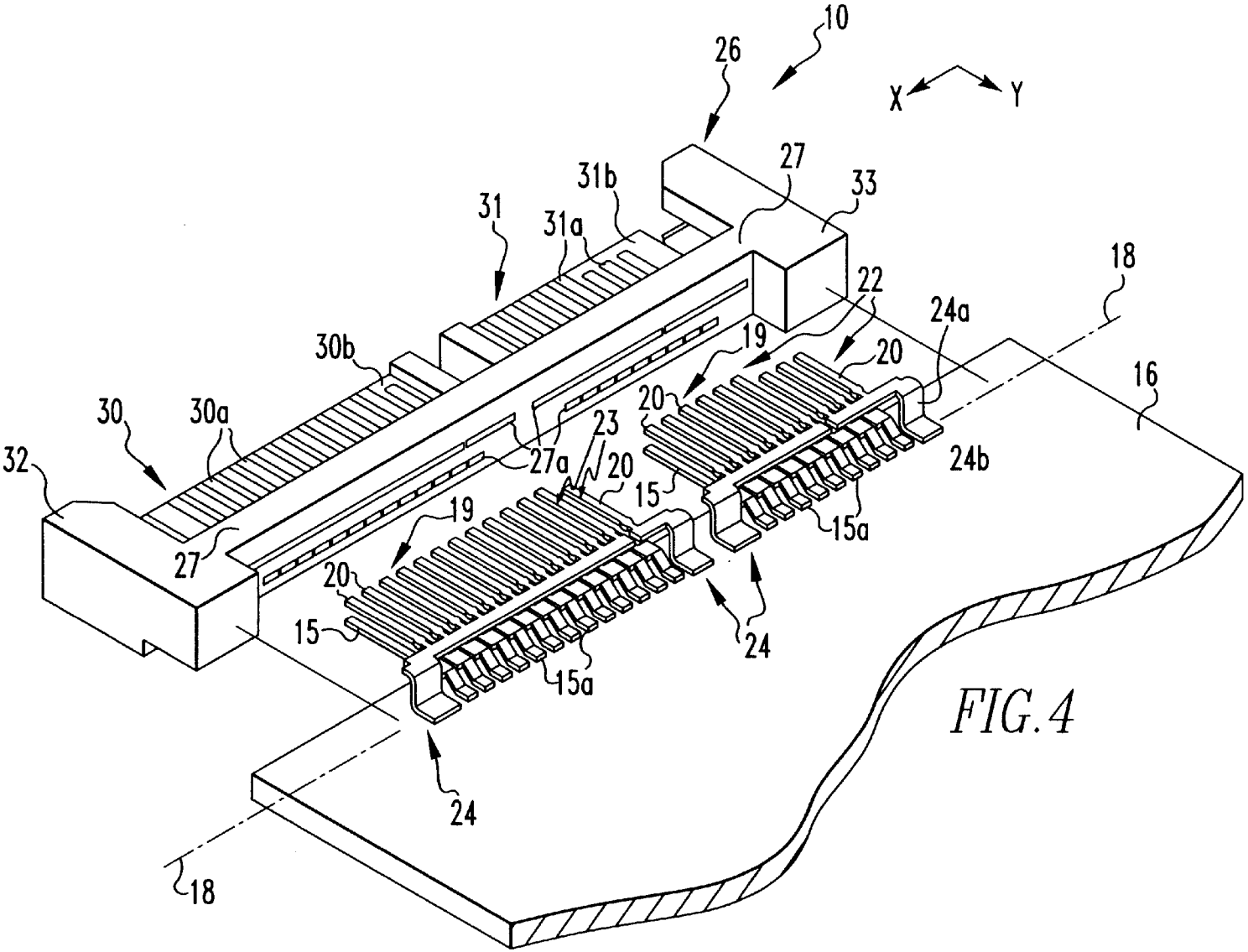
FIG. 4 is a partially exploded view of the connector of FIG. 1.

The invention further comprises a second electrical-contact array 19. The array 19 comprises one or more contacts 20. The contacts 20 are arranged in a substantially parallel orientation, as is best illustrated in FIG. 4. The center-to-center distance between adjacent contacts 20 is preferably about 0.050 inches. The exemplary embodiment comprises a total of twenty-two contacts 20.

Figure 1:
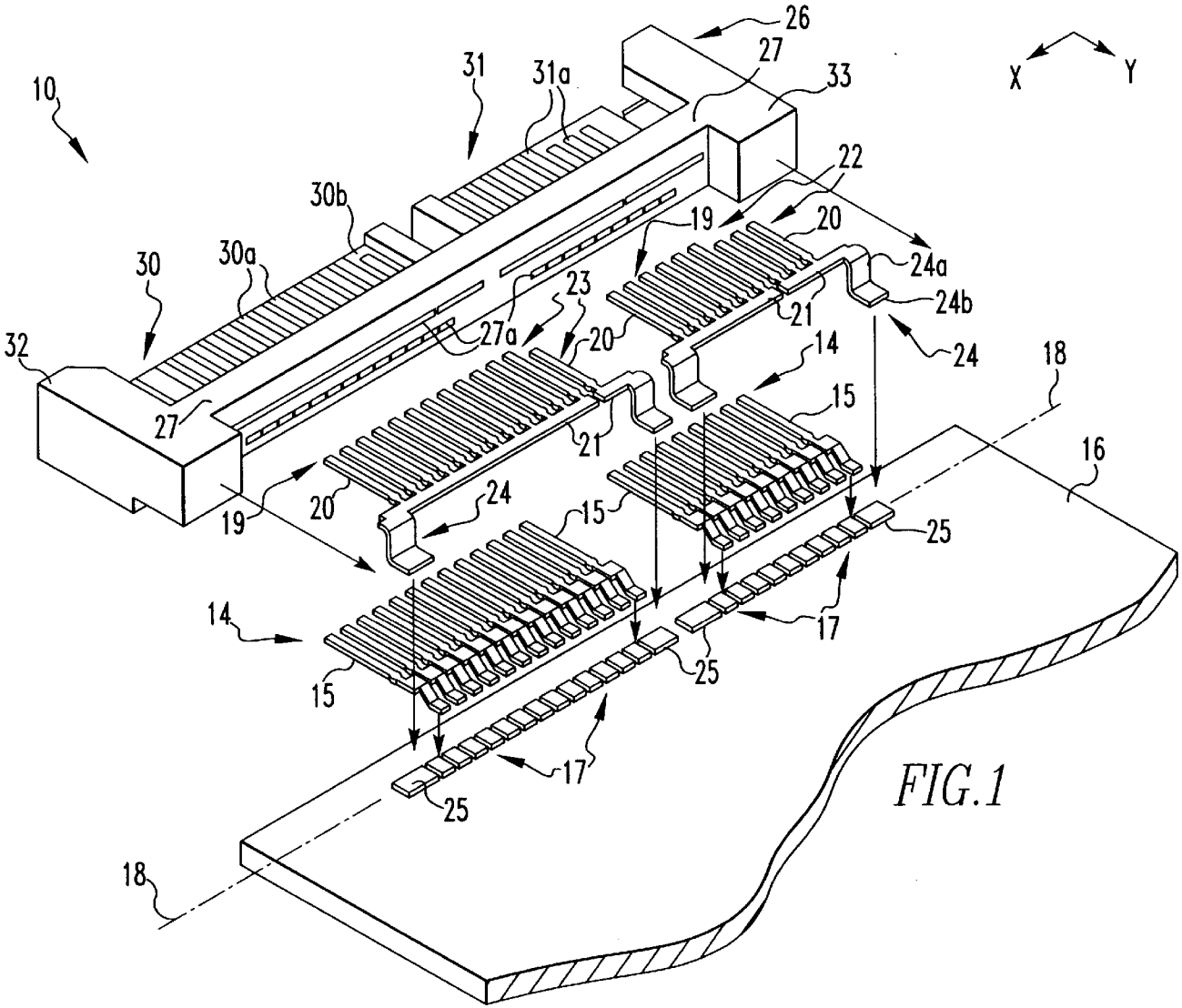
FIG. 1 is an exploded view of an electrical connector in accordance with the present invention.
Figure 3:
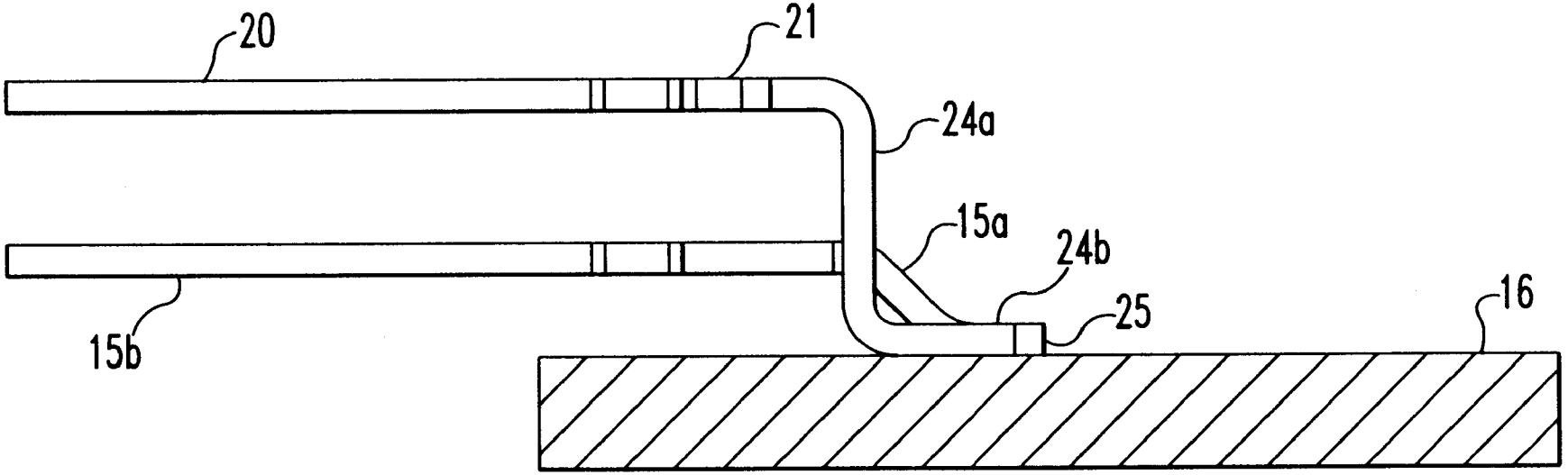
FIG. 3 is a side view showing an upper and a lower array of contacts of the connector of FIG. 1.

The contacts 20 are disposed at a fixed height directly above the elevated sections 15*a* of the contacts 15, i.e., the contacts 20 and the elevated sections 15*a* are vertically disposed above a common position on the PC board 16. (The term "above," as used in this context, signifies that the contacts 20 are located at a farther distance from the mounting surface, i.e., the board 16, than the elevated sections 15*a*. The contacts 20 may actually be positioned below the elevated sections 15*a* in applications in which the connector 10 is disposed on the underside of the board 16.) The contacts 15 and 20 thus define two substantially parallel rows of contacts. Furthermore, both rows are positioned above a common location on the PC board 16. This arrangement is best shown in FIGS. 1, 3, and 4. In addition, the contacts 20 are disposed in a substantially parallel orientation with respect to the contacts 15.

The contacts 20 are fixed to a transverse member 21. The transverse member 21 is made of an electrically-conducting material. The longitudinal axis of the transverse member 21 is disposed at an angle of about 90 degrees in relation to the longitudinal axis of each contact 20. Four transverse members 21 are utilized in the exemplary embodiment. The contacts 20 are grouped on the transverse members 21 in a manner that is most clearly shown in FIGS. 1 and 4. The grouping of multiple contacts 20 on a common member 21 (as illustrated in the figures) causes each member 21 to function as a bus, i.e., the members 21 conduct electrical signals between multiple sources and destinations. The bussing arrangement for a particular connector is tailored to the protocol of the electronic device with which the connector is to be utilized. For example, the disclosed embodiment is intended for use with devices that can be electrically coupled via two major connector groupings, e.g., a power grouping 22 and a signal grouping 23, with two subgroupings within each major grouping.

A tab 24 is disposed at an end of each transverse member 21. The tab 24 is made of an electrically conducting material. The tab 24 comprises a vertically-oriented member 24*a* and a horizontally-oriented base 24*b*. The base 24*b* is affixed to the PC board 16. Preferably, the base 24*b* is soldered to the board 16. The vertically-oriented member 24*a* elevates the transverse member 21 and the second contact array 20 in relation to the board 16 and the contact array 14. Furthermore, each tab 24 is laterally offset from the array 19, i.e., the tab 24 and the contacts 20 are disposed in different positions along the "y" axis denoted in the figures. Each tab 24 is also offset longitudinally from the array 19, i.e., the tab 24 and the contacts 20 occupy different positions along the "x" axis. The significance of these features is explained below.

Each base 24*b* is fixed to the PC board 16 at a mounting point 25. Each mounting point 25 is disposed along a projection of the line 18, i.e., the mounting points 25 and 17 are disposed in a substantially co-linear arrangement. Hence, the locations at which the contact arrays 14 and 19 are coupled to the board 16 are aligned in a single row.

The array 19 is suspended above the PC board 16 as a result of the geometric relationship between the contacts 20, the transverse member 21, and the tab 24. The lateral offset between the tab 24 and the contacts 20 allows all of the space directly below the contacts 20 to be utilized in accommodating the contacts 15. The co-linear arrangement of the mounting points 17 and 25 is facilitated by the grouping of the contacts 20 into a relatively small number of mounting tabs 24. This arrangement allows the mounting points 17 and 25 to be disposed along a single row with little or no increase in the length (x dimension) of the connector 10 relative to a comparable "dual-row" connector. Hence, the invention eliminates one of the primary disadvantages associated with arranging multiple arrays of contacts in a vertical grouping, i.e., the need for multiple rows of mounting points.

The exemplary connector 10 further comprises a housing 26. The housing 26 is formed from a rigid or semi-rigid, electrically-insulating material. The housing 26 comprises a longitudinal member 27 having a first tongue 30 and a second tongue 31. The housing 26 further comprises a first lateral member 32 and a second lateral member 33. The lateral members 32 and 33 are disposed at opposing ends of the longitudinal member 27.

The longitudinal member 27 includes a plurality of laterally-oriented apertures 27*a*. The tongues 30 and 31 each define a plurality of troughs 30*a* and 31*a*. The troughs 30*a* are disposed along an upper surface 30*b* and a lower surface 30*c* the tongue 30. The troughs 31*a* are likewise disposed along an upper surface 31*b* and a lower surface 31*c* of the tongue 31. Each trough 30*a* and 31*a* is substantially aligned with one of the apertures 27*a*.

The apertures 27*a* and the troughs 30*a* and 31*a* are adapted to engage the contacts 15 and 20. The contacts 15 and 20 are disposed within the apertures 27*a* and the troughs 30*a* and 31*a* when the connector 10 is fully assembled (FIG. 5). A portion of each contact 20 is exposed along the upper surfaces 30*b* and 31*b* of the tongues 30 and 31. A portion of each contact 15 is likewise exposed along the lower surfaces 30*c* and 31*c*. The housing 26 is fixed to an edge of the PC board 16, thereby securing the connector 10 to the PC board 16 (variants of the connector 10 within the contemplated scope of the invention may position the connector 10 at locations other than the edge of the PC board 16).

For exemplary purposes, the connector 10 is described in conjunction with a peripheral device 11 for use in a personal computer 12. The peripheral device 11 (including the connector 10) is guided into the bay 13 of the computer 12 by the engagement of grooves and rails (not shown) disposed along the sides of the bay 13 and the device 11. As the device 11 approaches its "installed" position within the bay 13, the connector 10 slidably engages a receptacle 34 fixed within the bay 13. More particularly, the receptacle 34 includes a plurality of contact elements 34*a* that engage the exposed surfaces of the contacts 15 and 20, as shown in FIG. 6. The engagement of the contact elements 34*a* and the contacts 15 and 20 electrically couples the peripheral device 11 and the computer 12.

Figure 8:
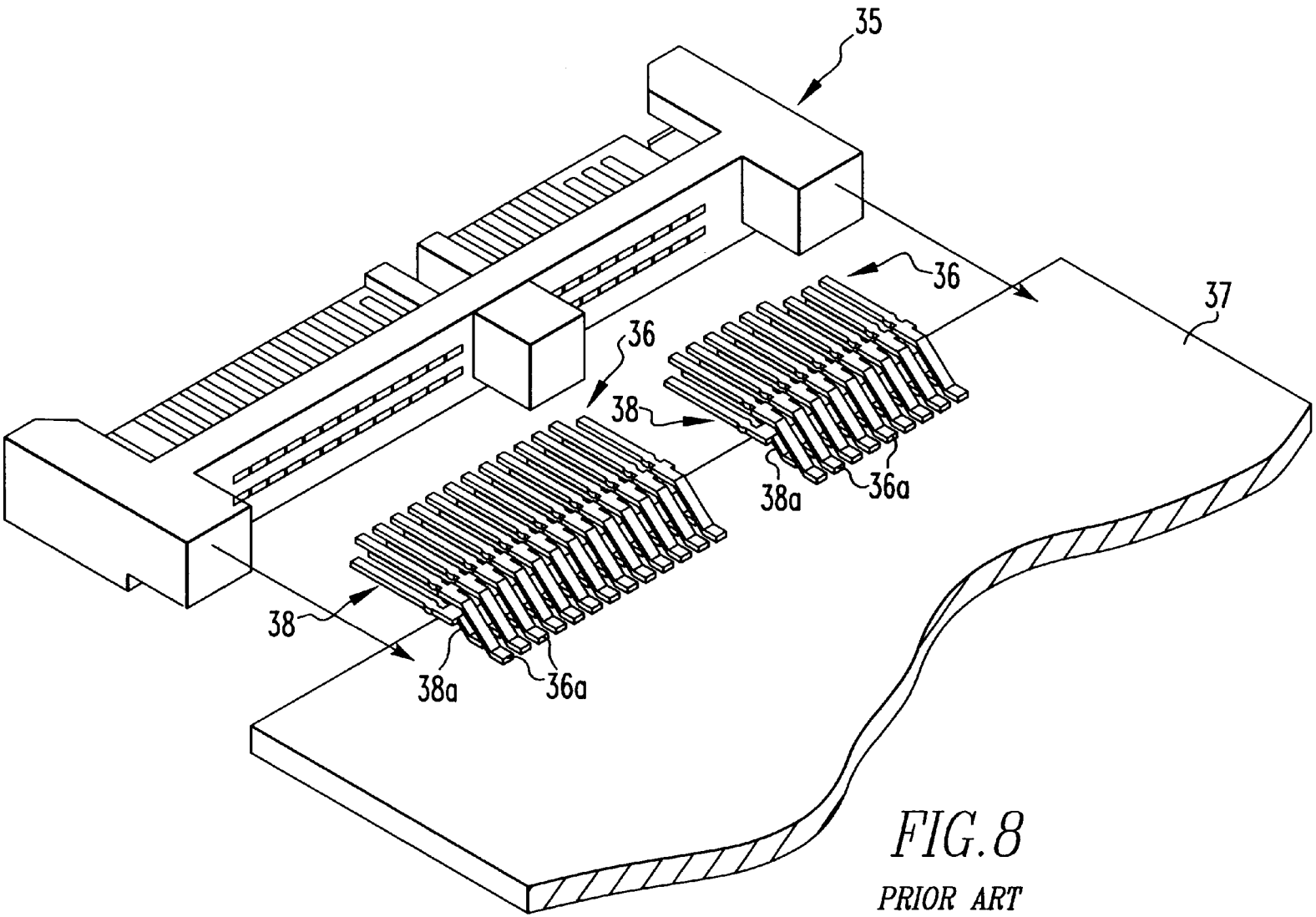
FIG. 8 PRIOR ART
FIG. 8 is a partially exploded view of a prior-art electrical connector comprising contacts that are fixed to a mounting surface along two rows.

The present invention thus furnishes a means for disposing electrical contacts on a planar surface in a manner that minimizes the amount of space occupied by the contacts both on and above the surface. The reductions in connector size provided by the invention are significant in light of the strict spatial constraints imposed on personal computers and many other electronic devices. Furthermore, this minimization is achieved without reducing the physical separation between individual contacts. For example, the exemplary embodiment possesses a maximum width (y dimension) of about 11.45 mm. FIG. 8 illustrates a comparable prior art connector 35 in which an upper row of contacts 36 are connected to a circuit board 37 via a second row of individual solder tails 36*a*. The connector 35 has a maximum width of about 12.95 mm. The greater width of the connector 35 is a result of the need to maintain physical separation between the solder tails 36*a* and solder tails 38*a* of a lower array of contacts 38.

The invention also eases the installation and removal of electronic devices. More specifically, the invention provides a connector 10 that allows electronic devices to be electrically coupled and decoupled without the need to rewire any electrical connections. Additionally, the design of the connector 10 simplifies the manufacturing and installation processes in relation to connectors such as the connector 28. In particular, the upper-level contact array 19 can be formed from a single stamping, thereby reducing the number of manufacturing steps. Furthermore, grouping multiple contacts 20 onto a single mounting point 25 reduces the number of soldering operations required to assemble the connector. Grouping the contacts 20 in the noted manner can also provide advantages from an electrical standpoint. For example, the signal grouping 23 in the described embodiment actually enhances the quality of the signal transmission at high switching speeds.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of the parts, within the principles of the invention to the full extent indicated by the broad general meaning of the terms in which the appended claims are expressed. For example, one particular variation of the connector 10 that falls within the scope of the invention forgoes the use of a lower array of contacts, i.e., the array 14. This embodiment can be used to suspend an array of contacts, e.g., the array 19, above an electronic component other than another grouping of contacts. Such an embodiment can be utilized to achieve a space savings similar to that described in connection with the disclosed embodiment. Another possible variation of the connector 10 may forgo the use of the housing 26. In this particular variant, the contacts 15 and 20 are coupled directly to a receptacle, i.e., a female connector, that is adapted to receive the contacts 15 and 20.

What is claimed is:

1. An electrical connector adapted for use on a substantially planar surface, comprising:

a first array of electrical contacts, said contacts being fixed to said substantially planar surface at mounting points on said surface, said mounting points defining a substantially straight line along said surface; and a second array of electrical contacts, said electrical contacts of said second array being substantially similar to said electrical contacts of said first array, said second array being stacked above said first array in relation to said substantially planar surface, said second array being coupled to a tab, said tab being fixed to said substantially planar surface along a projection of said substantially straight line.

2. The electrical connector of claim 1, further comprising a housing that engages said first and second contact arrays.

3. The electrical connector of claim 1, wherein:

at least a portion of said first array is disposed is a first plane, said first plane being vertically disposed above said substantially planar surface;

said second array is disposed in a second plane; and said substantially planar surface, said first plane, and said second plane are substantially parallel.

4. The electrical connector of claim 1, wherein said tab is laterally offset in relation said second array.

5. The electrical connector of claim 4, wherein said tab is longitudinally offset in relation said second array.

6. The electrical connector of claim 5, further comprising a transverse member, said second array and said tab being fixed to said transverse member.

7. The electrical connector of claim 6, wherein said tab comprises a projecting member and a base, said projecting member being fixed to said transverse member, said base being fixed to said substantially planar surface.

8. The electrical connector of claim 1, wherein said contacts in said first array each comprise a solder tail, said solder tails and said tab being fixed to said substantially planar surface by soldering.

9. The electrical connector of claim 2, wherein said housing comprises a longitudinal member having one or more apertures, said longitudinal member comprising a tongue having one or more troughs substantially aligned with said apertures, said apertures and said troughs engaging said first and second contact arrays.

10. The electrical connector of claim 9, wherein said troughs are disposed along an upper surface and a lower surface of said tongue.

11. The electrical connector of claim 1, wherein said substantially planar surface is a printed circuit board.

12. The electrical connector of claim 1, wherein said substantially planar surface is a surface of a peripheral device for a personal computer.

13. An electrical connector, comprising:

an array of electrical contacts, said array defining a first plane;

a transverse member, said array being fixed to said transverse member;

a tab unitarily formed with said array of electrical contacts, said tab being laterally offset in relation to said array, said tab comprising a base and a projecting member, said projecting member being fixed to said transverse member, said base defining a second plane and a housing that engages at least a portion of said contact array, said housing comprising a longitudinal member having one or more apertures, said longitudinal member comprising a tongue having one or more troughs substantially aligned with said apertures, said apertures and said troughs engaging said contact array.

14. The electrical connector of claim 13, wherein said tab is longitudinally offset in relation said array.

15. A system for electrically coupling a first and a second electronic device, comprising:

a plug, said plug comprising:

a first array of electrical contacts, said contacts being fixed to a substantially planar surface of said first electronic device at mounting points on said surface, said mounting points defining a substantially straight line along said surface;

a second array of electrical contacts, said electrical contacts of said second array being substantially similar to said electrical contacts of said first array, said second array being stacked above said first array in relation to said substantially planar surface, said second array being coupled to a tab, said tab being fixed to said substantially planar surface along a projection of said substantially straight line; and a housing that engages said first and second contact arrays; and a receptacle fixed to a surface of said second electronic device, said receptacle being adapted to engage said plug.

16. The system of claim 15, wherein said housing comprises a longitudinal member having one or more apertures, said longitudinal member comprising a tongue having one or more troughs substantially aligned with said apertures, said apertures and said troughs engaging said first and second contact arrays.

17. The system of claim 16, wherein said troughs are disposed along an upper surface and a lower surface of said tongue.

18. The system of claim 17, wherein said receptacle comprises a plurality of contact elements, said contact elements being adapted to engage said first and second contact arrays.

19. The system of claim 15, wherein said first electronic device is a peripheral device for a personal computer and said second electronic device is a personal computer.

20. An electrical connector adapted for use on a substantially planar surface, comprising:

a first array of electrical contacts, said contacts being fixed to said substantially planar surface at mounting points on said surface, said mounting points defining a substantially straight line along said surface;

a second array of electrical contacts, said second array being stacked above said first array in relation to said substantially planar surface, said second array being coupled to a tab, said tab being fixed to said substantially planar surface along a projection of said substantially straight line; and a housing that engages said first and second arrays, said housing comprising a longitudinal member having one or more apertures, said longitudinal member comprising a tongue having one or more troughs substantially aligned with said apertures, said apertures and said troughs engaging said first and second contact arrays.

21. An electrical connector, comprising:

an array of electrical contacts, said array defining a first plane;

a transverse member, said array being fixed to said transverse member;

a tab, said tab being laterally offset in relation to said array, said tab comprising a base and a projecting member, said projecting member being fixed to said transverse member, said base defining a second plane; and a housing that engages at least a portion of said contact array, said housing comprising a longitudinal member having one or more apertures, said longitudinal member comprising a tongue having one or more troughs substantially aligned with said apertures, said apertures and said troughs engaging said contact array.

* * * * *